US012551778B2

(12) United States Patent
Wanek et al.

(10) Patent No.: US 12,551,778 B2
(45) Date of Patent: Feb. 17, 2026

(54) SCALABLE MODULAR GAME SYSTEM

(71) Applicant: Adventure Together LLC, East Windsor, NJ (US)

(72) Inventors: Brian Wanek, Cambridge, MA (US); Christopher Torres, Hillsborough, NJ (US)

(73) Assignee: ADVENTURE TOGETHER LLC, East Windsor, NJ (US)

( * ) Notice: Subject to any disclaimer, the term of this patent is extended or adjusted under 35 U.S.C. 154(b) by 668 days.

(21) Appl. No.: 17/968,639

(22) Filed: Oct. 18, 2022

(65) Prior Publication Data

US 2023/0119955 A1 Apr. 20, 2023

Related U.S. Application Data

(60) Provisional application No. 63/257,167, filed on Oct. 19, 2021.

(51) Int. Cl.
*A63F 3/00* (2006.01)

(52) U.S. Cl.
CPC ..... *A63F 3/00261* (2013.01); *A63F 3/00176* (2013.01); *A63F 3/00214* (2013.01); *A63F 2003/00195* (2013.01); *A63F 2003/00375* (2013.01); *A63F 2003/00381* (2013.01); *A63F 2003/00482* (2013.01); *A63F 2003/00946* (2013.01)

(58) Field of Classification Search
None
See application file for complete search history.

(56) References Cited

U.S. PATENT DOCUMENTS

| | | | |
|---|---|---|---|
| 1,165,688 | A | 12/1915 | Maximilien |
| 1,689,107 | A | 10/1928 | Bradley |
| 2,635,355 | A | 4/1953 | Thompson et al. |
| 3,414,986 | A | 12/1968 | Stassen et al. |
| 3,487,579 | A | 1/1970 | Brettingen |
| 3,618,279 | A | 11/1971 | Sease |
| 3,877,170 | A | 4/1975 | Bakker |
| 3,917,272 | A | 11/1975 | Aldea |
| 4,025,076 | A | 5/1977 | Lipps |
| 4,057,253 | A | 11/1977 | Csoka |
| 4,093,236 | A | 6/1978 | Hoffa |
| D263,483 | S | 3/1982 | Chen |
| 4,357,018 | A | 11/1982 | Calvert |
| 4,534,567 | A | 8/1985 | Ferris et al. |
| 4,569,527 | A | 2/1986 | Rosenwinkel et al. |
| 4,580,787 | A | 4/1986 | Baker |
| 4,696,476 | A | 9/1987 | Eplett |

(Continued)

*Primary Examiner* — Jason T Yen
(74) *Attorney, Agent, or Firm* — LOZA & LOZA, LLP; Joseph G. Swan

(57) ABSTRACT

Provided is a game system that includes game pieces, each having a perimeter that includes multiple edges, such that each edge of any individual one of the game pieces meshes with each edge of any other individual one of the game pieces, with all of the edges, across all of the game pieces, being identical to each other. Also, each of the edges is contoured such that when a first edge of a first piece is meshed with a second edge of a second piece, movement between the first piece and the second piece is limited, but the first piece and the second piece are not interlocked with each other so that they can be simply slid apart from each other.

20 Claims, 8 Drawing Sheets

(56) References Cited

U.S. PATENT DOCUMENTS

| | | | | |
|---|---|---|---|---|
| 4,828,268 | A | 5/1989 | Somerville | |
| 4,955,615 | A | 9/1990 | Eck | |
| 5,048,840 | A * | 9/1991 | Johnson, Jr. | A63F 3/00214 273/282.3 |
| 5,057,049 | A | 10/1991 | Kaczperski | |
| 5,061,218 | A | 10/1991 | Garage et al. | |
| 5,108,109 | A | 4/1992 | Leban | |
| 5,333,878 | A | 8/1994 | Calhoun | |
| D370,034 | S | 5/1996 | Kipfer | |
| D387,431 | S | 12/1997 | Tremblay | |
| 5,871,212 | A * | 2/1999 | Lee | A63F 3/02 446/120 |
| 5,988,640 | A | 11/1999 | Wheeler | |
| 6,050,044 | A | 4/2000 | Mcintosh | |
| 6,352,262 | B1 | 3/2002 | Looney | |
| 6,431,547 | B1 | 8/2002 | Arkoosh et al. | |
| 6,511,073 | B2 | 1/2003 | Simonds | |
| 6,866,266 | B1 | 3/2005 | Thorne | |
| D532,832 | S | 11/2006 | Van Ness | |
| D536,390 | S | 2/2007 | Van Ness | |
| D536,391 | S | 2/2007 | Van Ness | |
| 2003/0127800 | A1 | 7/2003 | Kenney | |
| 2006/0043674 | A1 | 3/2006 | Van Ness | |
| 2007/0029729 | A1 * | 2/2007 | Baker | A63H 33/38 273/285 |
| 2020/0206603 | A1 | 7/2020 | Buck | |
| 2020/0298098 | A1 * | 9/2020 | Imai | A63F 3/00643 |

* cited by examiner

SCALABLE MODULAR GAME SYSTEM

This application claims the benefit of U.S. Provisional Patent Application Ser. No. 63/257,167, filed on Oct. 19, 2021, which application is incorporated by reference herein as though set forth herein in full.

FIELD OF THE INVENTION

The present invention pertains, among other things, to systems, apparatuses, components, methods and techniques related to toys and games, such as board or tabletop games in which three-dimensional structures can be built up from a number of individual components or pieces.

BACKGROUND

The following discussion concerns certain background information related to the present invention, including discussion of relevant prior art, and also provides the present inventors': (1) observations regarding and/or characterizations of prior art; and (2) identification and analysis of some of the shortcomings in the prior art and/or problems that the present invention addresses. It should be understood that only knowledge clearly, explicitly and specifically described herein as being "conventional" or "prior art" is intended to be characterized as such. Everything else should be understood as knowledge and/or insight originating from the present inventors themselves.

A variety of different three-dimensional tabletop games exist. These conventional games commonly have utilized interlocking, coupling, mating, or interconnected hexagonal tiles, which allow for interchangeable and player-customized board constructions. However, the present inventors have determined that such conventional game systems typically are quite limiting, e.g., in terms of:

- how players can scale boards to fit any play area prior to construction;
- how players can organize and store small components, dice, and cards during gameplay;
- how interlocking mechanisms between elements restrict assembly, disassembly, or rearrangement of these elements during gameplay, while increasing overall cost to manufacture and likelihood of breakage; and/or
- how many shapes and configurations of board constructions are possible.

SUMMARY OF THE INVENTION

The present invention addresses these shortcomings by, among other things, by providing a novel game system in which pieces mesh, but do not interlock, with each other.

Thus, one embodiment of the invention is directed to a game system that includes game pieces, each having a perimeter that includes multiple edges, such that each edge of any individual one of the game pieces meshes with each edge of any other individual one of the game pieces, with all of the edges, across all of the game pieces, being identical to each other. Also, each of the edges is contoured such that when a first edge of a first piece is meshed with a second edge of a second piece, movement between the first piece and the second piece is limited, but the first piece and the second piece are not interlocked with each other so that they can be simply slid apart from each other.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the accompanying drawings. However, it should be understood that the drawings merely depict certain representative and/or exemplary embodiments and features of the present invention and are not intended to limit the scope of the invention in any manner. The following is a brief description of each of the accompanying drawings.

DESCRIPTION OF THE PREFERRED EMBODIMENT(S)

For ease of reference, the present disclosure is divided into sections. The general subject matter of each section is indicated by that section's heading. However, such headings are included simply for the purpose of facilitating readability and are not intended to limit the scope of the invention in any manner whatsoever.

One implementation of a system according to the present invention (sometimes generally referred to herein as a "Scape System") provides for a highly scalable, non-interlocking, modular game board, with a rigid, enclosed barrier, featuring component management functionality, enabling custom board configurations, and a more organized method of gameplay and component storage. A Scape System preferably is centered around components, pieces or tiles (such terms often used, and generally capable of being used, interchangeably herein) that are non-interlocking and have, or are based on, a hexagonal-like shape (e.g., a modified-hexagon shape) as the basic unit of construction (for simplicity, each such basic unit being referred to herein as a "hex"). At the same time, a Scape System preferably also employs larger structures, e.g., including structures that are essentially multiple such hex pieces joined together, preferably permanently (but in some cases semi-permanently). These hexes and larger structures preferably can be assembled in any of a variety of configurations to build a modular board (or structure) representing various three-dimensional environments. Benefits can include, e.g.: removing limitations on player creativity, providing a higher-definition aesthetic to board constructions, and enabling easy assembly, disassembly, and rearrangement of the board—before, during, and/or after gameplay.

Game Pieces

Figure 1:
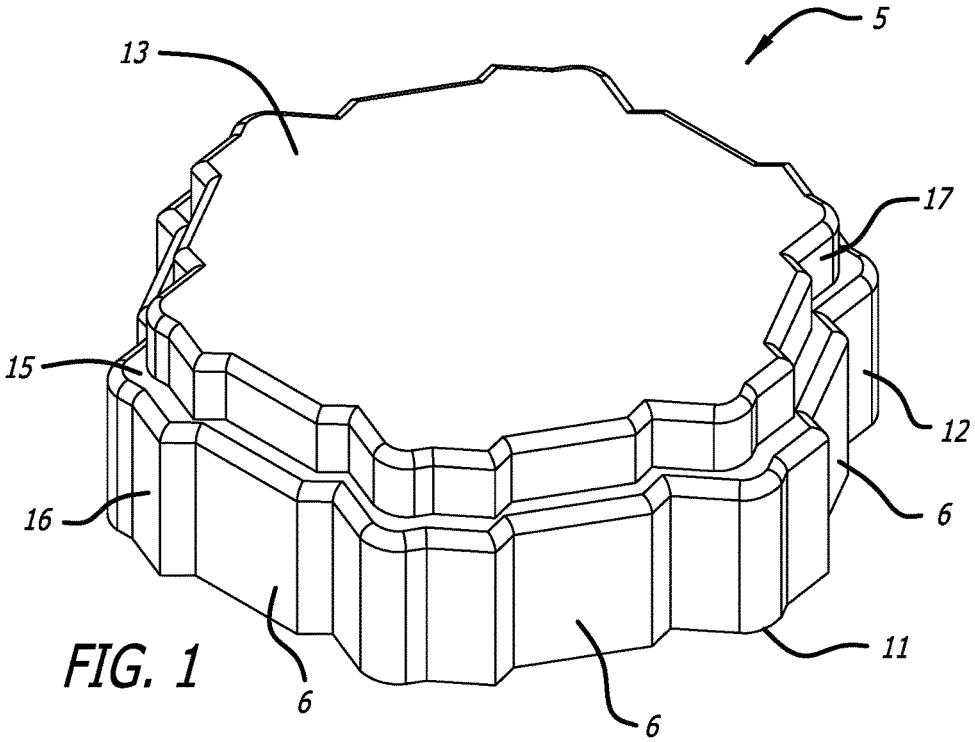
FIG. 1 is a perspective view of a buildable hex piece according to a representative embodiment of the present invention.
Figure 2:
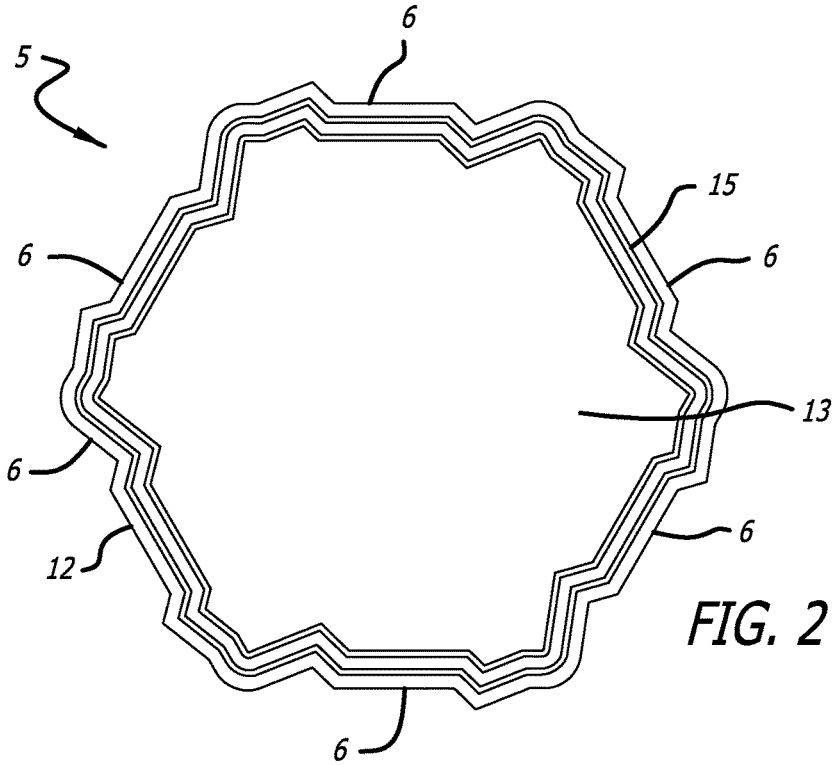
FIG. 2 is a top plan view of the buildable hex piece.

A single buildable hex piece 5 is shown in FIGS. 1 and 2. Buildable hex piece 5 typically is the basic building block of the currently preferred Scape System. The relevant circumference of buildable hex piece 5 (e.g., the portion that meshes with other pieces) preferably is based on a nominal 45 millimeter (mm) hexagon (measured vertex-to-vertex). As shown, such relevant circumference of buildable hex piece 5 is similar to a geometric hexagon in that it has six sides or edges 6. However, unlike a geometric hexagon, those six sides 6 are not straight, but rather, each edge 6 preferably has a contour that facilitates the location and orientation of such pieces relative to one another, but do not lock them into place (as discussed in greater detail below).

In addition, buildable hex piece 5 preferably is hollow (e.g., so that the depicted structure has an open bottom 11, just thin sidewalls 12 and a thin top surface 13) and also has a ridge 15 along its perimeter, such that the bottom portion 16 of buildable hex piece 5 is larger than, but preferably proportionate to, concentric with, and aligned with, its top portion 17. In the current embodiment, the sidewalls 12 of both the bottom portion 16 and the top portion 17, as well as the opening in its bottom 11, have the subject hex configuration (e.g., edges 6), and ridge 15 is just slightly wider than the thickness of the sidewalls. This configuration permits at least two assembly options.

Figure 3:
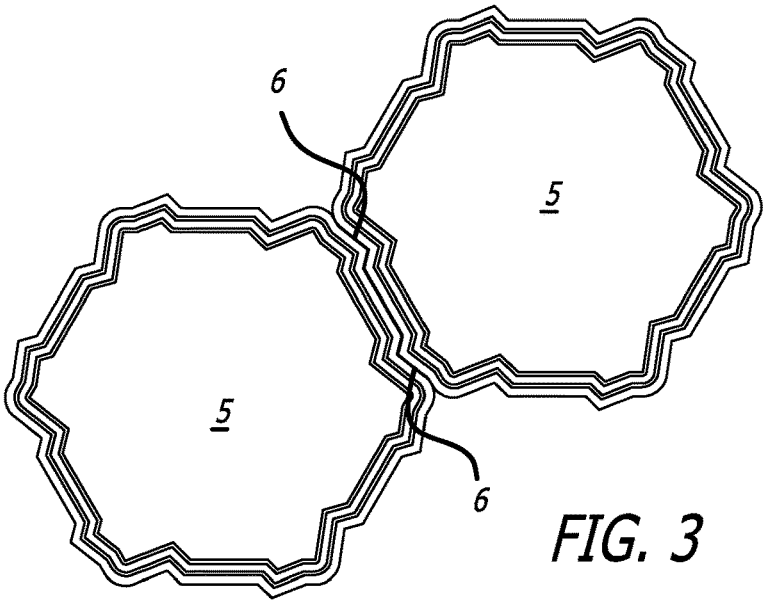
FIG. 3 is a top plan view of two buildable hex pieces, abutting each other.

First, FIG. 3 illustrates how two such single buildable hex pieces 5 fit together, side-by-side. In this regard, due to the configuration of the edges 6 (discussed in greater detail below), any buildable hex piece 5 can be placed next to any other buildable hex piece 5. More specifically, any edge 6 of one buildable hex piece 5 meshes with any edge 6 of any other buildable hex piece 5 such that there is no significant gap between such edges 6. In this case, it is the contoured circumference of the bottom portions 16 of such buildable hex pieces 5 that mesh with each other.

Figure 4:
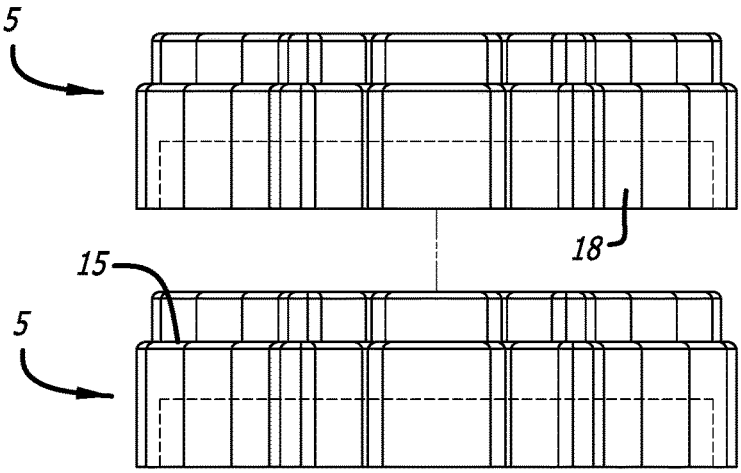
FIG. 4 is a side elevational view of two buildable hex pieces, with one about to be stacked on top of the other.

Also, as shown in FIG. 4, the inward step forming ridge 15 allows one buildable hex piece 5 to nest inside another buildable hex piece 5, i.e., to allow stacking of the buildable hex pieces 5. For this purpose, opening 18 is illustrated as being just deep enough to accommodate the top portion 17 of the buildable hex piece 5. Often, however, buildable hex piece 5 is entirely hollow, so that opening 18 also extends up into top portion 17. As discussed in greater detail below, this configuration can permit stacking of different kinds of components, e.g., for building up a variety of different kinds of landscapes. Preferably, such stack nesting utilizes a clearance fit (e.g., with opening 18 having a cross-section that is just slightly larger than the circumference of top portion 17) which allows for easy, one-handed removal of pieces off the top of the stack, but is not too loose such that the stack can rotate or translate any significant or noticeable amount.

As shown in the drawings, the top surface 13 of a buildable hex piece 5 preferably is flat, providing a large area for application of a design, e.g., to distinguish different types of game pieces. For instance, in the preferred implementations of a Scape System, different patterns or designs are applied to the top surfaces of different pieces to distinguish different types of biome or landscape features, e.g., grass, trees, rock, etc. More preferably, such patterns or designs are applied using an ultraviolet (UV) printing technique, with each such pattern or design indicating the type of piece that it is intended to be for purposes of particular gameplay.

While in the currently preferred specific embodiment these graphics indicate different kinds of types of biome (e.g., as listed for the exemplary game described below), in other games that utilize a Scape System, they can represent other kinds of items (typically related to that particular game's common theme and its corresponding gameplay rules). Also, in alternate embodiments such patterns or designs are applied or otherwise provided in other ways instead of (or in addition to) UV printing, e.g., printed in another way, being pre-formed or subsequently cut into the top surfaces of the pieces, and/or applied as decals or stickers.

One of the unique features of building components in accordance with the preferred embodiments of the present invention is the way that the edges are formed. With respect to buildable hex piece 5, this generally refers to the configuration of the sidewalls 12 on its bottom portion 16 (although, as noted above, in the preferred embodiments, the sidewalls 12 of the top portion 17 have the same configuration but just somewhat scaled down in size).

As illustrated, this configuration preferably includes ridged, contoured features that locate the components (e.g., hexes or hex pieces) relative to one another, but do not lock them into place. This allows for easy assembly, disassembly, and rearranging during gameplay, while keeping the components on a desired (e.g., hexagonal in the current example) grid (e.g., with no or very limited lateral drift while building). Such ridged features preferably also prevent rotational movement when components are stacked on top of each other.

Figure 5:
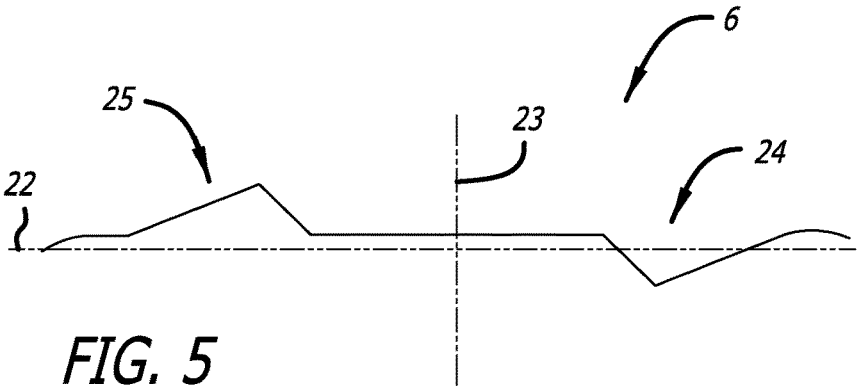
FIG. 5 shows one of the six sides or edges of a hex-based circumference (such as the peripheral edge of one of the sides of the bottom portion of the buildable hex piece), along with a center dividing line.

The preferred edge configuration is a contour along the perimeter of each such component (or piece) that facilitates the location and orientation of such pieces relative to one another, but do not lock them into place. The preferred characteristics or features in this regard are as follows: (1) each side (or edge) of the hex (and/or, e.g., in alternate embodiments, other polygon-based) piece is contoured in a manner that is identical to each other edge; (2) referring to FIG. 5, with respect to each such edge (the particular edge 6 employed in the present example being illustrated), if such edge 6 is divided exactly in half (as shown by imaginary centerline 23), the right side 24 of the dividing line 23 is identical to the left side 25 when either such side 24 or 25 rotated 180°; (3) at each position around the perimeter, the contour includes just a single point (e.g., no doubling back, so that any ray originating from the center point would intersect exactly one point on the perimeter); and/or (4) the contour varies smoothly and continuously (preferably without any, or many, vertices), constantly or almost constantly changing in radius (i.e., the distance from the center point to the perimeter), along the entire perimeter. Each edge preferably varies from a straight line (which would be the shape of an edge in a actual hexagon or other type of polygon) in a modified and/or irregular sawtooth or wavelike pattern. For example, with reference to FIG. 5, the depicted edge 6 rises above and then descends below an imaginary horizontal centerline 22 (and/or its then-current position) one or more times from either end of the edge 6 to its centerline 23, and then observes the preferred symmetry requirement in its other half.

For any given Scape System, all the relevant edges (i.e., all the edges that are intended to mesh with other edges) have the same standardized configuration (in the example presently discussed, edge configuration 6), preferably, with the foregoing properties. Generally speaking, any reference herein to edge 6 or edge configuration 6 can be replaced with a reference to any other edge or edge configuration having one or more (preferably all) of the foregoing properties.

Features (1) and (2) ensure that any edge of one piece meshes with any edge of another piece; however, alternate configurations that ensure proper meshing of desired edges also or instead can be used in alternate embodiments. Feature (3) precludes dovetail, T-shaped and other mating configurations that would result in pieces interlocking with each other (e.g., capable of being separated vertically, such as by lifting one away from the other, but not slid apart horizontally); more generally, any configuration that results in interlocking (rather than just meshing) preferably is not used. Aspects of feature (4), or similar requirements for variations in the perimeter contour, often can limit the amount of movement between adjacent pieces, which is particularly important when stacking a large number of pieces on top of each other (e.g., limiting the amount of tilt that can occur if straight edges are used). A non-interlocking design according to the present invention often can allow for easy assembly, disassembly, and rearranging during gameplay while keeping hex pieces within a hexagonal grid and ensuring no (or at least significantly reducing) lateral drift while building or playing.

In addition, ridged features (such as ridge 15) also can prevent rotational movement, or collapse due to applied horizontal force, of stacked hexes. As previously noted, an inward step on the top surface of the bottom portion of the component (e.g., bottom portion 16) allows one component to nest inside the component above it, with the stacked components being hollow, at least to a depth sufficient to accommodate the top portion (e.g., top portion 17) of the component beneath it, thereby facilitating such stacking. This stack nesting preferably is a clearance (i.e., fairly loose) fit which allows for easy, one-handed removal of pieces off the top of the stack, but not too loose such that the stack can rotate or translate any significant or noticeable amount during use. For this purpose, the interior cavity (e.g., opening 18) at the bottom of a component (e.g., buildable hex piece 5) preferably is approximately 0.4 mm (e.g., 0.3-0.5 mm) wider than the portion above its ridge line (e.g., top portion 17). Moreover, the design of each hex preferably maximizes its top surface area (e.g., the top surface 13 of top portion 17), and, at least in the currently preferred embodiments, that top surface area preferably is flat, so as to facilitate the preferred UV printing, as noted above.

Figure 6:
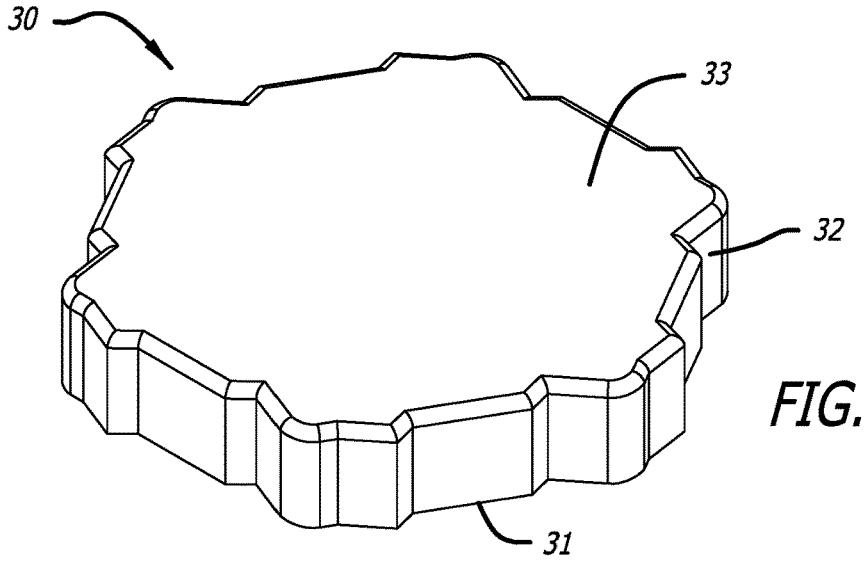
FIG. 6 is a perspective view of a non-buildable (or top-level) hex piece according to a representative embodiment of the present invention.
Figure 7:
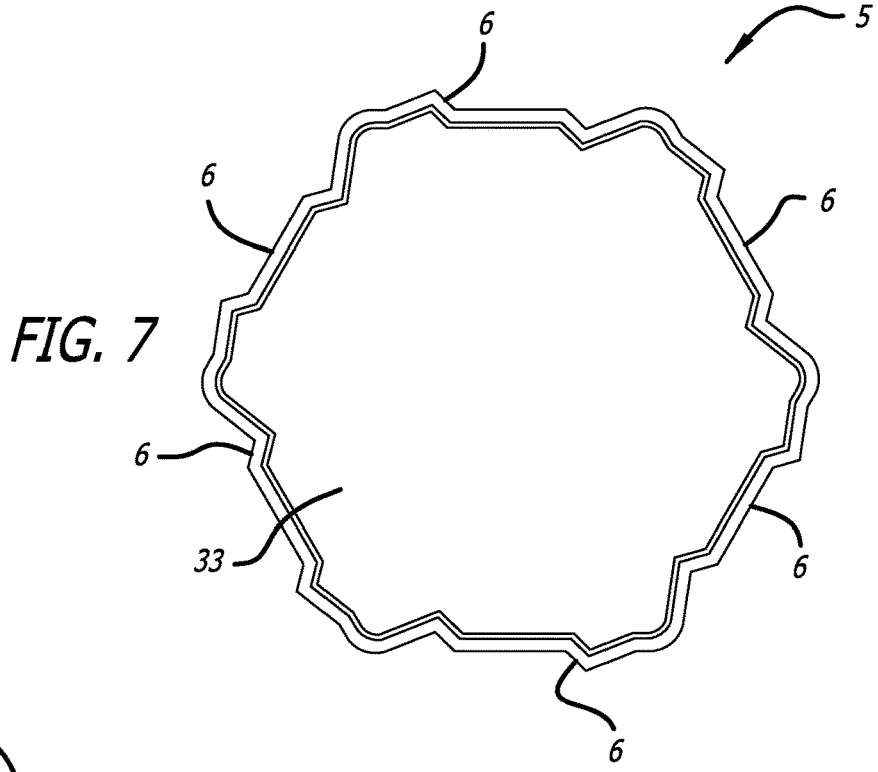
FIG. 7 is a top plan view of the non-buildable hex piece.

The preferred embodiments of the present invention also include another type of component: a non-buildable (or top-level) hex piece 30, e.g., as shown in FIGS. 6 and 7. Non-buildable hex pieces 30 preferably incorporates many of the same design elements as buildable hex piece 5. For example, non-buildable hex piece 30 has an open bottom 31, thin sidewalls 32 and a thin top surface 33. In addition, the perimeter of non-buildable hex piece 30 preferably is identical to the perimeter of the bottom portion 16 of buildable hex piece 5, with six edges 6 (in this case forming its entire sidewalls 32), so that a buildable hex piece 5 and a non-buildable hex piece 30 can be placed side-by-side, with their abutting edges 6 intermeshing with each other in the same (or in a similar) manner as that shown in FIG. 3.

Figure 8:
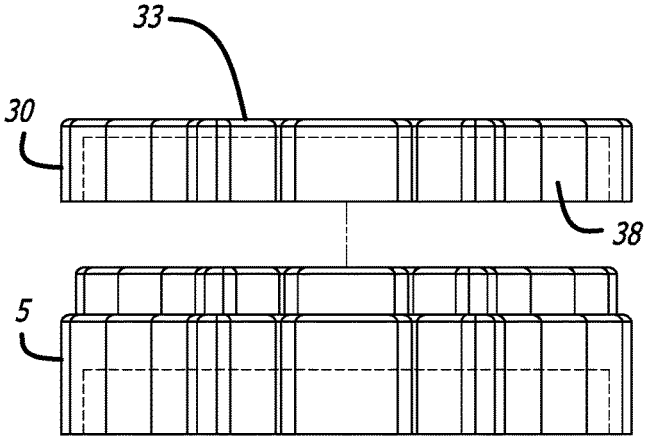
FIG. 8 is a side elevational view showing a non-buildable hex piece about to be stacked on top of a buildable hex piece.

However, in the currently preferred embodiment, non-buildable hex pieces 30 have entirely straight, vertical sidewalls 32 and a completely flat top surface 33, so as not to allow stacking on top of them, which is a gameplay rule in the current embodiment, meaning that these non-buildable hex pieces 30 can only be on the very top of a stack of game pieces or components. In other words, a non-buildable hex piece 30 preferably does not include a ridge 15 and corresponding smaller top portion 17 or, for that matter, any other structure that would facilitate stacking any other component on its top surface. As shown, in the current embodiment, the top surface 33 of hex piece 30 exactly matches its bottom footprint. Again, the reason for this structure is that non-buildable hex pieces 30 are intended to be the top level of the structure at that position, precluding any further building up (or stacking) there. At the same time, while other components cannot be stacked on top of non-buildable hex pieces 30, because they are hollow (or at least have an appropriate opening 38) and have the same bottom footprint as a buildable hex piece 5, a non-buildable hex piece 30 can be stacked on top of a buildable hex piece 5, e.g., as shown in FIG. 8. For that purpose, opening 38 preferably is identical to opening 18 (for buildable hex piece 5), or at least has the same cross-section, and the same considerations discussed above in relation to opening 18 generally also apply with respect to opening 38.

Similar to buildable hex pieces 5 and 20, non-buildable hex piece 30 also has a flat top surface 33 (although, lacking a smaller-footprint top portion 17, its top surface 33 is slightly larger than the top surface 13 of buildable hex piece 5) that can be printed or otherwise provided with a desired pattern or design. The same considerations for applying such patterns or designs, as discussed above in relation to top surface 13, also apply with respect to top surface 33 (as well as the top surfaces of all other game pieces used in the Scape System). In the currently preferred game that is implemented using the present invention, such non-buildable hex pieces 30 often represent water biomes and their top surfaces 36 are imprinted or otherwise provided with a pattern indicating water. As a result, such components can be used, e.g., to create a lake or other body of water on the ground surface or at a higher elevation. In other variations, such pieces can be designated in any other manner (e.g., as representing lava, quicksand, etc.), representing other types of biomes that are not intended to be built upon.

Figure 9:
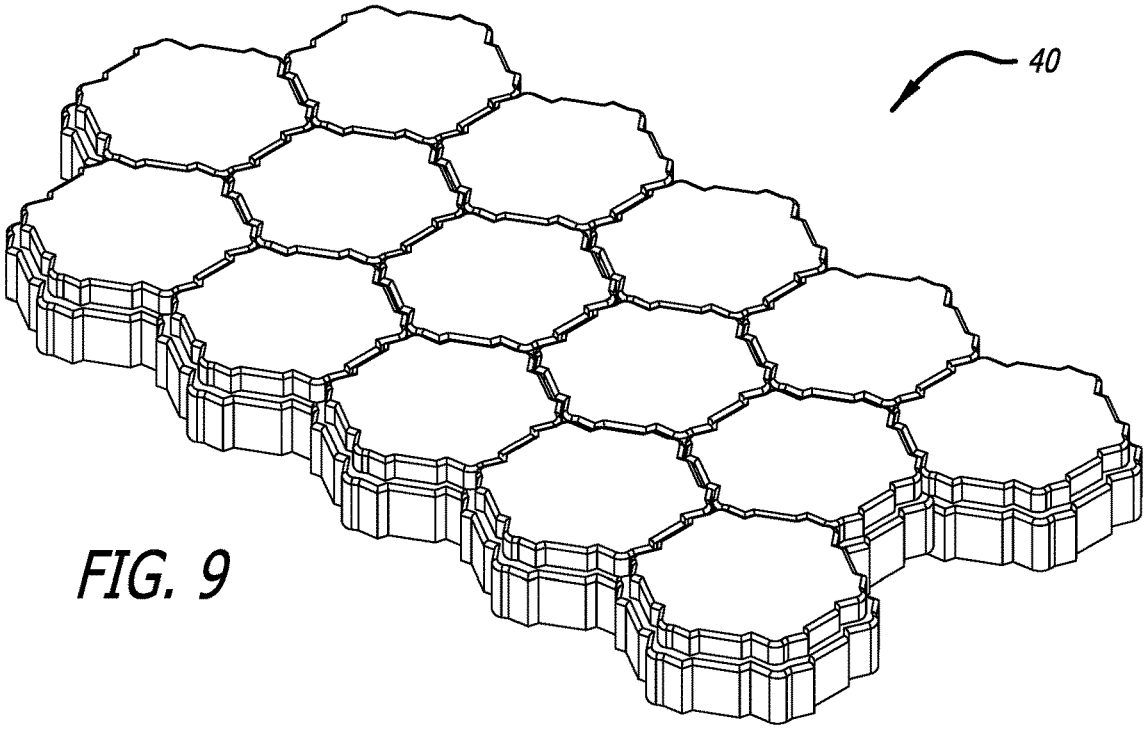
FIG. 9 is a perspective view of a multi-hex component.
Figure 10:
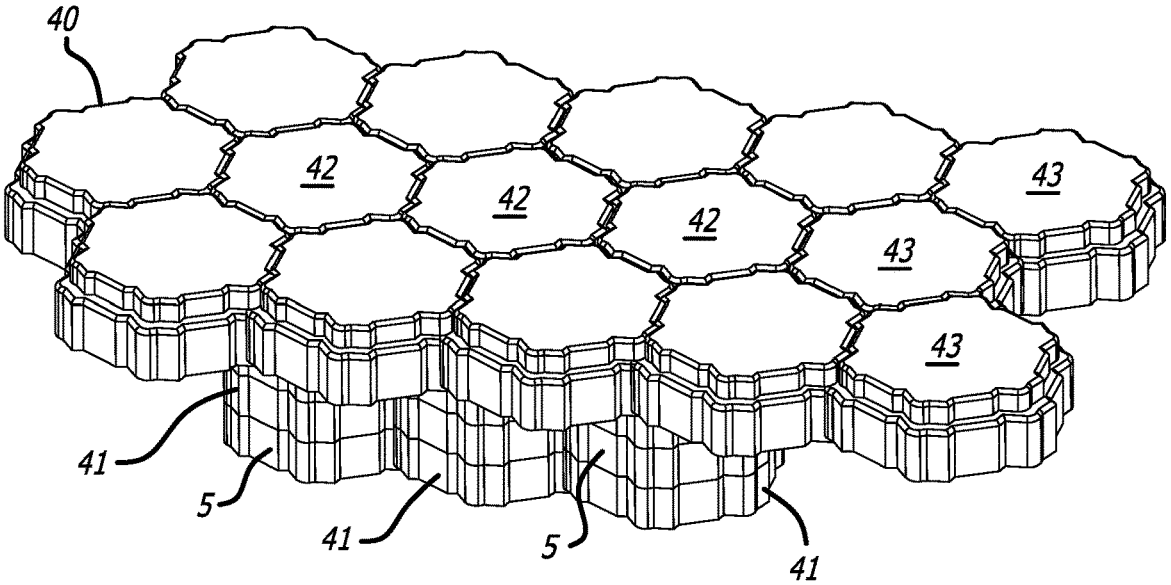
FIG. 10 is a perspective view of a multi-hex component, as stacked on top of, and also overhanging, other hex components.
Figure 11:
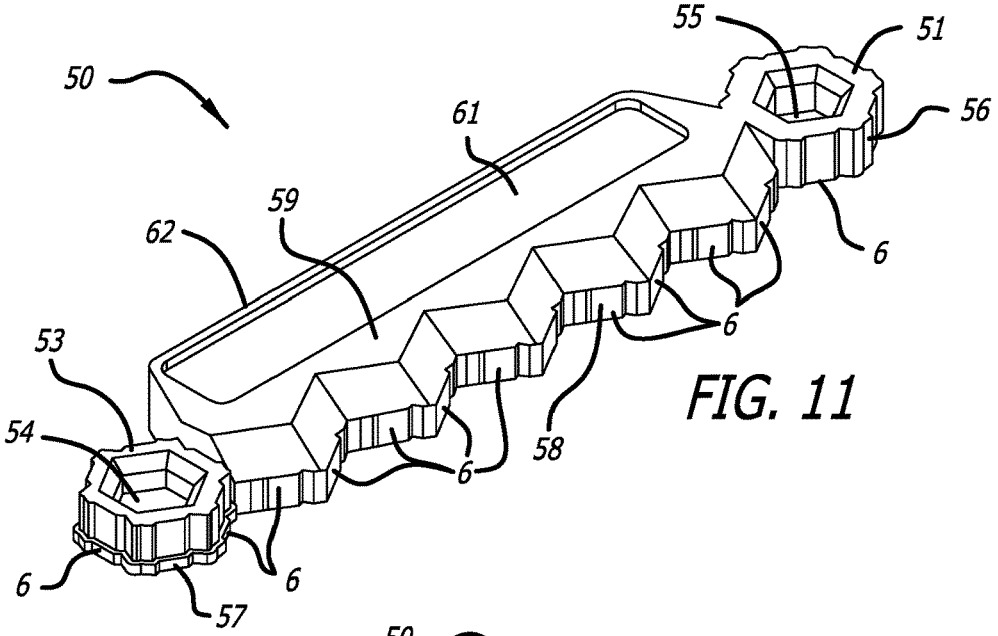
FIG. 11 is a perspective view of a first border piece.
Figure 12:
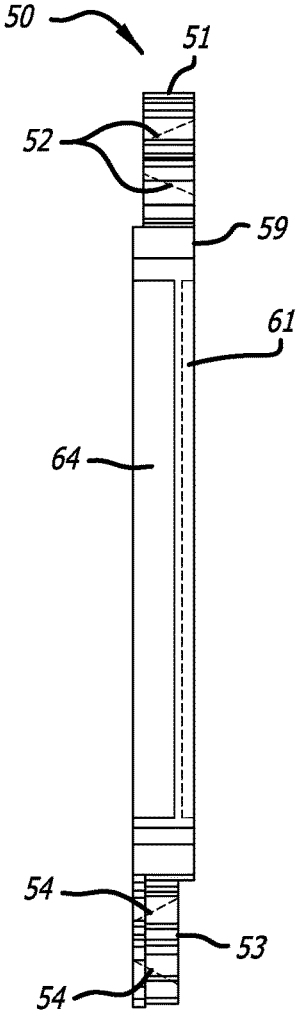
FIG. 12 is a rear elevational view of the first border piece.
Figure 13:
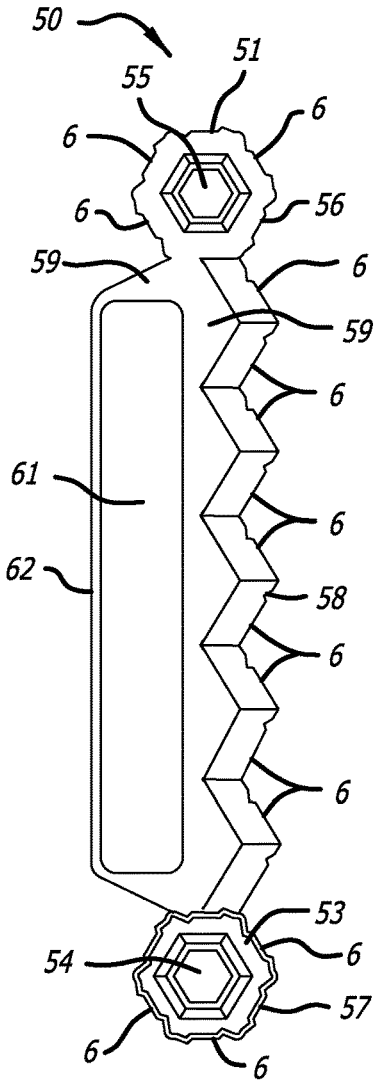
FIG. 13 is a top plan view of the first border piece.
Figure 14:
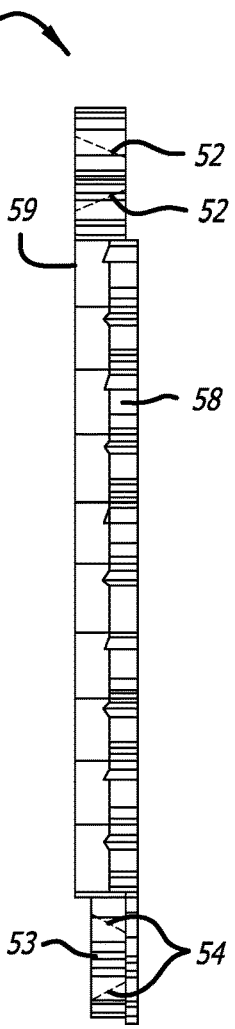
FIG. 14 is a front elevational view of the first border piece.
Figure 15:
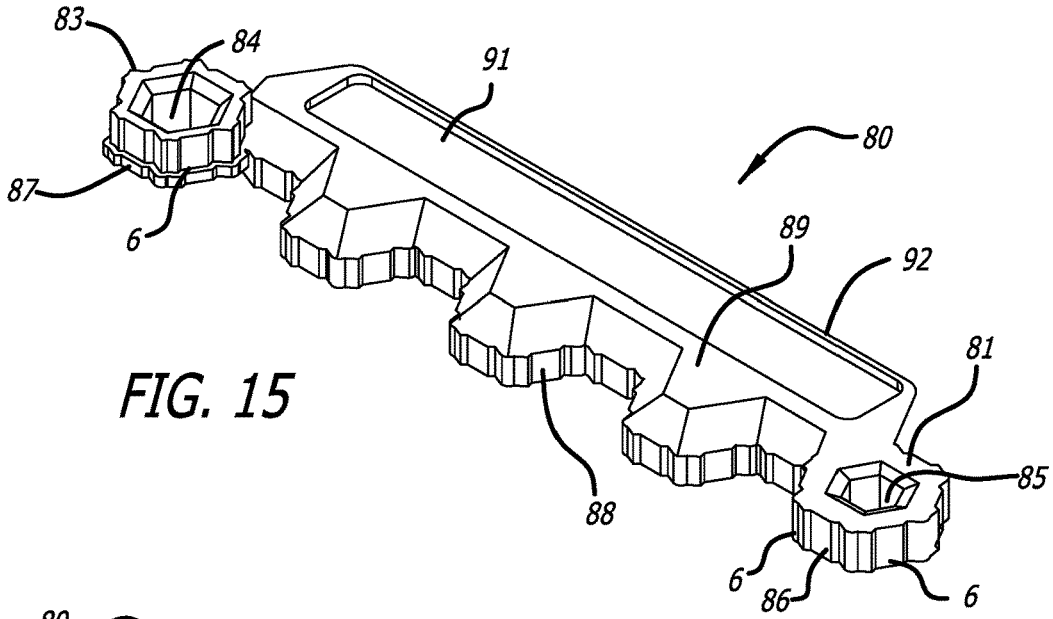
FIG. 15 is a perspective view of a second border piece.
Figure 16:
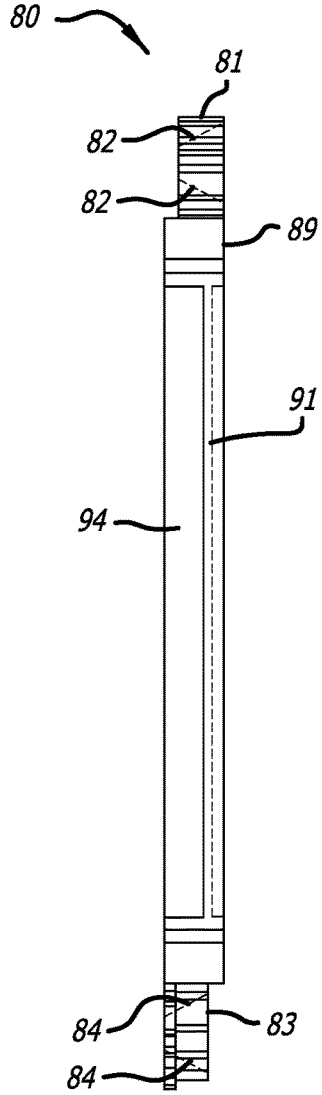
FIG. 16 is a rear elevational view of the second border piece.
Figure 17:
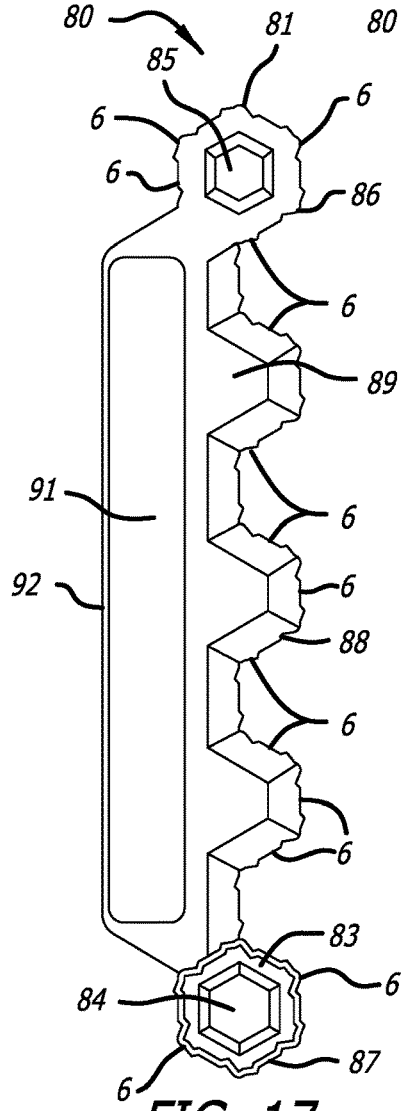
FIG. 17 is a top plan view of the second border piece.
Figure 18:
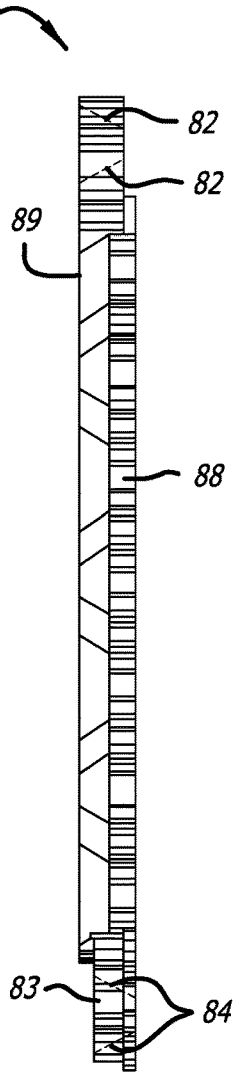
FIG. 18 is a front elevational view of the second border piece.

Still further, in addition to the single-hex pieces described above (i.e., buildable hex piece 5 and non-buildable hex piece 30), a Scape System according to the present invention preferably also includes multi-hex pieces, such as the pentadeca hex piece 40 shown in FIG. 9 (which is just one example of a multi-hex tile or piece, which in this case is made up of 15 individual hexes). This configuration preferably incorporates all the same design elements as in a single-hex piece, but allows players to build a base layer easily and quickly, or form overhang terrain (e.g., as shown in FIG. 10, which shows pentadeca hex piece 40 stacked on top of three abutting stacks 41 of individual buildable hex pieces 5).

A multi-hex piece can be formed as a number (e.g., 15 in the present example) of individual hex pieces (e.g., each identical to buildable hex piece 5 or non-buildable hex piece 30), but with their adjacent edges permanently joined together. Alternatively, its bottom openings can be offset and/or rotated relative to the top structures, e.g., for stacking or assembling such multi-hex piece on top of other components in alternate ways. While multi-hex piece 40 includes 15 individual hexes (more specifically, generally corresponding to buildable hex pieces 5 in this example), any other number or kind of tiles or pieces also or instead may be joined into a unitary multi-hex tile or piece for use by the players.

In any event, a multi-hex piece (such as pentadeca hex piece 40) preferably can be placed on the base surface for the game, or placed on top of one or more single-hex pieces, multi-hex pieces (provided that they are buildable, e.g., appropriately shaped top portions such as top portion 17, at least in the area(s) where such multi-hex piece makes contact with them), and/or stacks of either or both of the foregoing types of game pieces. In the current embodiment, pentadeca hex piece 40 is an essentially flat arrangement of single-hexes, allowing it to be stacked on top of other buildable game pieces, provided that such buildable game pieces extend to the same height. In alternate embodiments of the present invention, at least one multi-hex piece instead is terraced or arranged in a staircase configuration, so that different portions of it are resting on buildable hexes at different heights.

As noted above, one advantage of a multi-hex piece is that it can be used to create an overhang. This configuration is shown in FIG. 10, in which pentadeca hex piece 40 is placed on top of multiple buildable hex pieces 5, but with only some of the hexes forming pentadeca hex piece 40 directly above (e.g., supported by) corresponding buildable hex pieces 5 (i.e., hexes 42), with other hexes forming pentadeca hex piece 40 (i.e., hexes 43) providing an overhang.

Border Pieces

A Scape System according to the present invention preferably also includes (preferably elongated) border pieces that permit the players to form a border or enclosure on a base surface (such as a tabletop), within which horizontal plane other pieces (such as the game pieces described above) can be placed to form the base layer of the desired structure. More preferably, any two such border pieces can be mated or otherwise attached end-to-end and, depending upon the type(s) of border pieces used, can be mated or attached, e.g., so as to form a straight line, or at an acute or obtuse angle. In any event, in the preferred embodiments, such border pieces preferably can be attached end-to-end so as to form a rigged, enclosed barrier to hold single-hex and multi-hex pieces.

For this purpose, in the currently preferred embodiments, each such border piece has one end with a male mating component (e.g., protrusion) and one end with a female mating component (e.g., an opening that mates with the male component). Mating between such border pieces occurs between the female end of one border piece and the male end of another border piece. More preferably, such mating is a noticeably light press fit which allows the players to easi's process ly assemble and disassemble the border pieces, while also providing some rigidity.

A first exemplary border piece 50 is shown in FIGS. 11-14. At one end 51 of border piece 50 is a male (insertion) component 52, and at its other end 53 is a female opening 54 that mates with male component 52. In the current embodiment, each of such components 52 and 54 has a hexagonal cross-section. While that shape is preferred, in alternate embodiments, other shapes are used, provided that the shape used for component 52 preferably match the shape used for component 54 and vice versa. More preferably, the cross-sectional shapes of components 52 and 54 match the basic shape upon which the game pieces are based (hexagon in the current example), particularly when such basic shape is a polygon. By matching that basic shape, it can be ensured that the angles at which the border pieces attach to each other match the angles of the game piece edges in the interior space defined by such border pieces, thereby permitting the entire interior space to be fully occupied by game pieces.

Also, in the preferred embodiments, both male component 52 and female component 54 are tapered (e.g., with male component 52 being narrower at its distal end than at its proximal end, and female component 54 being wider at the top of the opening than at its bottom). In alternate embodiments, just one of male component 52 or female component 54 is tapered. Tapered mating feature(s) (e.g., on male insertion component 52 and/or on female opening 54) can aid in assembly and disassembly, while also providing a more-secure fit. In the current embodiment, female opening 54 is exposed on the top surface of female end 53, while male insertion component 52 is formed as a hollow depression within male end 51, thereby also providing a small storage space 55 that can be used to hold, e.g., a dodecahedral (or other kind of) die, or can be used for expansion/add-on pieces (e.g., cup holders, additional game piece holders, dice towers, etc.).

As shown in FIGS. 11-14, the inwardly facing (or inner) side 58 of border piece 50, the entire outer circumference 56 of male end 51, and the entire outer circumference 57 of female end 53 preferably all have the same discrete contoured edges 6 (to the extent such circumferences 56 and 57 are exposed) as the sides of a hex piece (e.g., buildable hex piece 5 or non-buildable hex piece 30), so that male end 51 and female end 53 are capable of meshing with such game pieces, such as pieces 5 and/or 30 (or, subject to size constraints, meshing with multi-hex pieces, such as pentadeca hex piece 40, as well). More preferably, each border piece used in the Scape System preferably incorporates, on its interface edge, the same (e.g., hex-based) design elements as are found on the perimeter of a single hex, arranged in the same way. Such use of the same border contours (e.g., edges 6) often can prevent (or at least substantially limit) rotation of the border piece joint (discussed in more detail below). In current embodiment, the structure of border piece 50 slopes upwardly away from inner side 58 and then flattens out at its top surface 59.

Border piece 50 preferably also incorporates any of a variety of additional game piece organization and/or storage features (e.g., in addition to storage/expansion space 55, discussed above), such as a shallow tub 61 along its outer side 62 (e.g., for storing tokens and/or dice) and/or a cubby 64 (e.g., for slotting in cards, player mats, or other flat pieces on the table surface).

A second exemplary border piece 80 is shown in FIGS. 15-18. Border piece 80 generally shares the same design elements as border piece 50, but its design is altered somewhat, e.g., to allow a perpendicular arrangement of border pieces within an otherwise hexagonal-oriented grid. That is, as discussed in greater detail below, in combination, border piece 50 and border piece 80 enable 90° corners to be formed. These 90° corners allow players to build rectangular boards based on hexagonal pieces in order to maximize play space on a game table—as most game tables are rectangular.

For this purpose, elements 81-89, 91, 92 and 94 (shown in FIGS. 15-18) correspond (e.g., subject to the following differences, are identical) to elements 51-59, 61, 62 and 64, respectively, with the main differences being that female end 83 (including female opening 84) and male end 81 (including male insertion component 82) are rotated 30° relative to corresponding female end 53 (including female opening 54) and male end 51 (including male insertion component 52). Because the present embodiment uses a hexagon-based shape, the amount of this rotation is ½ of the angle subtended by each edge (i.e., 30° of rotation in this case). In addition, for similar reasons, the inner side 88 of border piece 80 is configured to accept a hex at a first orientation (e.g., with an edge parallel and adjacent to the length of border piece 80 in this particular example), while the inner side 58 of border piece 50 is configured to accept a hex at a second orientation that also is 30° rotated relative to the first orientation (e.g., with a line from the center to one of the vertices of the hex being perpendicular to the length of border piece 50 in this example). As noted above, all of the edges along the inner sides 58 and 88 of border pieces 50 and 80, respectively, have the same standard configuration 6.

As indicated, border piece 80 is just a somewhat modified version of border piece 50. Except as noted above, the same comments and considerations pertaining to border piece 50 also apply with respect to border piece 80.

Figure 19:
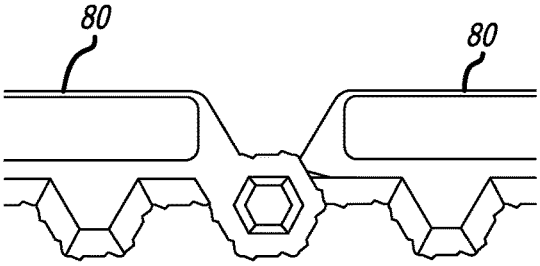
FIG. 19 is a top plan view showing two border pieces attached in a straight line (i.e., at an angle of exactly 180°).
Figure 20:
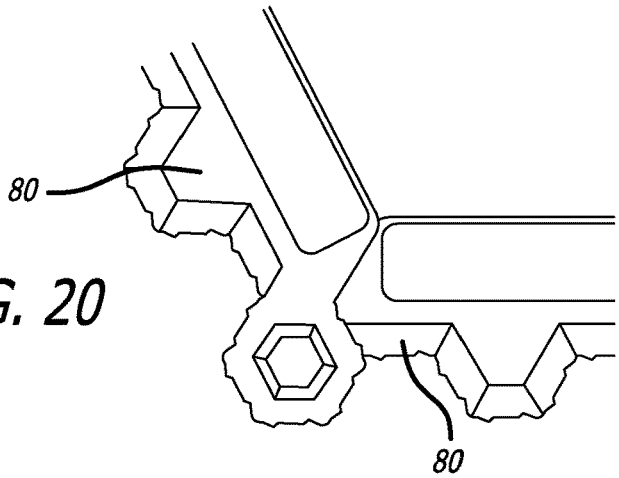
FIG. 20 is a top plan view showing two border pieces attached at an angle greater than 180°.
Figure 21:
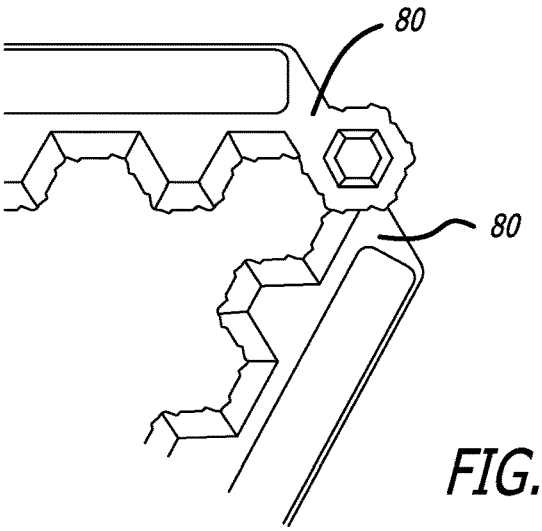
FIG. 21 is a top plan view showing the attachment of two border pieces at an angle less than 90°.

FIGS. 19-21 illustrate how two border pieces 80 can be attached end-to-end (i.e., by attaching the male end 81 of one such border piece 80 to the female end 83 of another such border piece 80) in different ways that allow for: (1) straight end-to-end attachment (i.e., exactly 180°, as shown in FIG. 19), (2) greater than 180° attachment (e.g., 240°, as shown in FIG. 20) or acute attachment ((e.g., 60°, as shown in FIG. 21). The same possibilities are available for attaching two border pieces 50 end-to-end. Generally speaking, in this embodiment (which uses a hexagon-based basic shape), when attaching two of the same type of border piece (e.g., each being a border piece 50 or each being a border piece 80), the two border pieces can be attached in a straight (180°) line or at 60° increments away from straight, e.g., subject to other physical constraints of the border pieces themselves.

Figure 22:
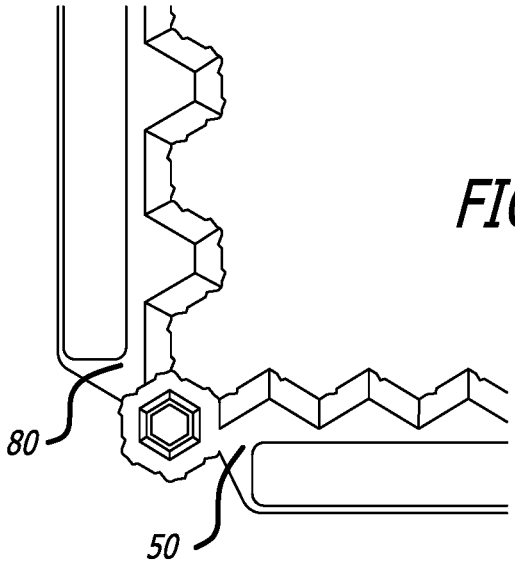
FIG. 22 is a top plan view showing the attachment of two border pieces at a right angle (i.e., an angle of exactly 90°).

On the other hand, due to the 30° offset noted above, a border piece 80 can be attached to a border piece 50 at a 90° (perpendicular or right) angle, e.g., as shown in FIG. 22, or at 60° increments away from a right angle, e.g., again subject to other physical constraints of the border pieces themselves. The ability to provide such 90° border corners means that players can build rectangular boards or spaces, even though the game pieces themselves are based on a hexagonal shape, which is very advantageous given that most game tables are rectangular.

Finally, it should be noted that the border pieces discussed above are essentially straight segments. However, alternate border pieces according to the present invention need not be straight, but each preferably is at least piecewise straight (i.e., made up of a sequence of straight segments), particularly when enclosing (or otherwise used in conjunction with) game pieces that employ a polygon-based elemental shape (as in the present embodiment). Also, border pieces according to the present invention can be of any desired length, with longer border pieces allowing for faster assembly of the overall border and with shorter border pieces allowing for more precise control over the shape of the overall border.

Game Play

As discussed above, a Scape System preferably is designed around non-interlocking hex (or, in alternate embodiments, other polygon-based) tiles or pieces which can be assembled in a variety of configurations to build a modular board representing various three-dimensional environments. Typically, the overall architecture of a game design revolves around the border pieces, which preferably form a rigid, enclosed barrier to contain any number of non-interlocking hex tiles or pieces. Such game pieces, in turn, can be assembled from the center outwardly or from the borders inwardly. As discussed above, the game pieces or tiles preferably can be assembled in the x, y (horizontal plane) and z (vertical) axes. The border pieces preferably can be configured into any of a variety of different shapes, allowing for board designs, e.g., custom to the space available to the players or intentionally selected so as to impose desired design constraints. As indicated above, a Scape System preferably includes a variety of different hex and border pieces, each serving a unique purpose.

These hexes (and/or, in alternate embodiments, other basic building blocks having other, preferably polygon-based, shapes) preferably locate and orient such basic building blocks relative to one another, but do not lock them together in any manner whatsoever. This preferred fitting (or meshing), but non-interlocking, design feature often can minimize lateral drift while building or playing, and ridged features (e.g., ridge 15) also help prevent rotational movement or potential collapse due to horizontal forces applied to stacks of such basic building blocks. An inward step, preferably provided on the top surface of the bottom portion of each (or at least a plurality) of the tiles, allows each buildable tile to nest inside a tile placed above it, with the tiles or pieces preferably being hollow (at least partially) and, therefore, the can be stacked. This stack nesting preferably uses a clearance fit, which allows for easy, one-handed removal of pieces off the top of the stack, but preferably is not too loose such that the stack can rotate or translate during use. The omission of mating components and/or accessories from the game pieces reduces both the likelihood of breakage, as well as the cost of manufacture, therefore significantly reducing overall board costs and increasing the durability and ease of use of individual hexes.

Figure 23:
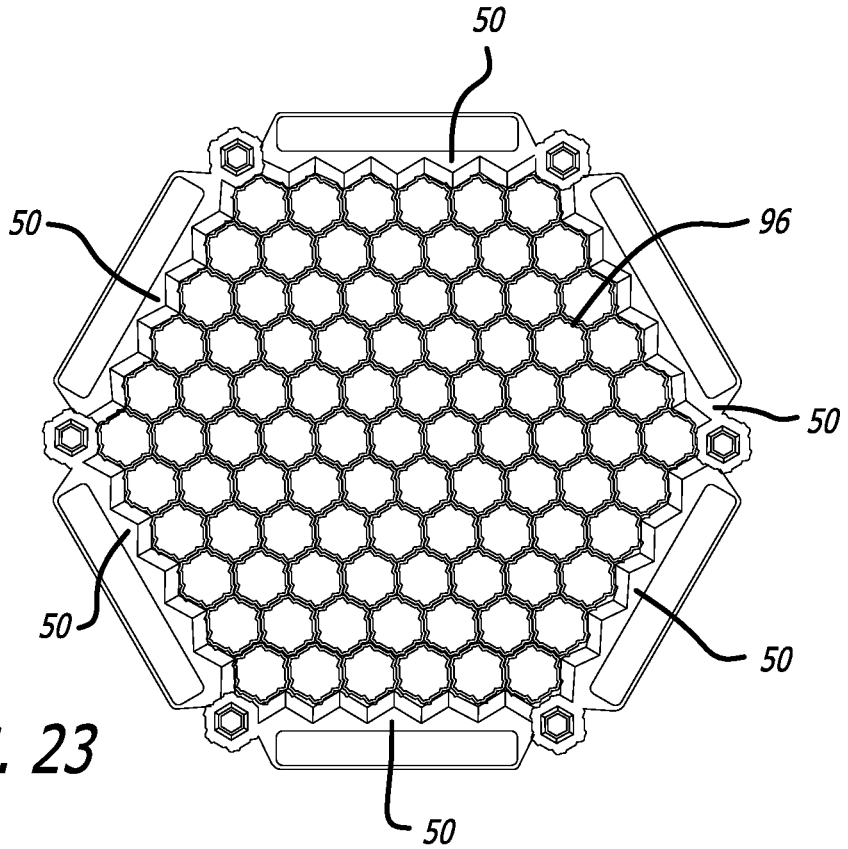
FIG. 23 is a top plan view of an entire game setup using pieces of the present invention.

A top plan view of an entire game setup, including border pieces and game pieces, is shown in FIG. 23. In this example, an enclosed border is formed entirely from border pieces 50, by attaching them end-to-end at 60° angles. As a result, the interior space 96 can be used to build on a hexagonal grid. The game pieces within interior space 96 can include, e.g., buildable single-hex pieces 5, non-buildable (or top-level) single-hex pieces 30 or pentadeca hex pieces 40. Also, any of such pieces can be at the base (e.g., tabletop) level or at any height (by stacking). From the view shown in FIG. 23 these variations are not visible. For example, in the preferred embodiments, it is only possible to distinguish a single-hex piece from a multi-hex piece through close visual inspection.

A system according to the preferred embodiments of the present invention has the three-dimensionality and versatility of traditional hex tiles, but deviates from conventional systems, e.g., due to its novel non-interlocking single and multiple-combined (e.g., pentadeca) hex elements which are enclosed by easily mated, ridged border elements with built-in component management functionality. This allows for easy assembly, disassembly, and rearranging during gameplay, while keeping hex tiles within a hexagonal grid and providing a place to store components such as cards, dice, markers, and resources, currency, and other small pieces which normally take up space and create a disorganized environment for players. These designs remove restrictions from hex tile placement and stacking to enable terraforming gameplay and to ensure unrestricted building and stacking in any direction, allowing for infinite scalability, modularity, and customization of board construction.

In short, a Scape System can provide for a three-dimensional play surface for any game, while: being highly scalable, modular, stackable, easily assembled, disassembled, and rearranged before, during, and after gameplay; allowing for customization and expansion of elements by players; being more durably constructed and more affordably manufactured; and/or providing a solution for organization, storage, and management of game components and cards. To simplify the present discussion, the basic building blocks of the Scape System are assumed to be hex-shaped or hex-based (which is preferred for the attachment angles that they support). However, it should be understood that basic building blocks having other shapes (preferably polygon-based and, more preferably, based on a regular polygons instead (or also) are used in alternate embodiments. Therefore, references herein to hexes or hex shapes can be replaced with corresponding references to such other shapes in connection with alternate embodiments of the present invention.

A Scape System can be used for the customization of boards for independent game systems to be played on, meaning, any tabletop game system design generally can be adapted to play or be specifically designed to be played upon a Scape System board construction. The Scape System preferably marries a customizable board with endless variations of gameplay mechanics. It can be thought of as a console, which as a singular product supports a plurality of games.

For example, one tabletop board game, called "TimeScape" uses the preferred embodiment of a Scape System, described above, as its board/environment, because the mechanics of the game play out over a customized, buildable, destructible and landscape-shifting board construction. The customized board is made up of single and Pentadeca hexes. Pentadeca hexes typically are used to fill in the bottom-most and top-most layers of the board (e.g., providing bridges) while individual hexes are used, e.g., to fill in everything in-between. Hexes play a key role in that game, as they can be mined and placed in a player's Player Area as "materials". Materials can then be used to upgrade the player's "Fort" or crafted into "Road" hexes and placed back on the board to provide trade routes and movement benefits. Borders create the boundary of the board and serve as component management during gameplay. They are the first thing placed before filling the board area in with Hexes and Tiles. In this game, Tiles are used to represent water. Tiles preferably have a larger surface area than hexes, but a slightly lower height and no stackability (non-buildable). Water tiles can be used for "Fishing" when an adjacent Character chooses to use the Fishing action. Biomes are what sit on the surface of each Hex and Tile in the game. Currently, the following 6 Biomes are contemplated for TimeScape:

1. Sand: the primary biome in TimeScape.
2. Blend: a biome used to blend obsidian and sand more naturally.
3. Obsidian: a biome that is commonly found on the lower and mid-elevations.
4. Rock: a biome commonly found in high elevations.
5. Water: a biome for fishing and swimming.
6. Road: a biome that is placed during gameplay, created using other mined biomes, that gives a movement benefit to characters on it when connected to their fort and can create a trade route from the player's fort. Roads can also be utilized during team play to connect teammates forts to one another for trade.

Miniatures, which can be placed on the biomes, preferably also are included and are provided with hex bases to accommodate the hex elements of the Scape System board/game pieces.

Additional Considerations.

As used herein, the term "attached", or any other form of the word, without further modification, is intended to mean directly attached, attached through one or more other intermediate elements or components, or integrally formed together. In the drawings and/or the discussion, where two individual components or elements are shown and/or discussed as being directly attached to each other, such attachments should be understood as being merely exemplary, and in alternate embodiments the attachment instead may include additional components or elements between such two components. Similarly, method steps discussed and/or claimed herein are not intended to be exclusive; rather, intermediate steps may be performed between any two steps expressly discussed or claimed herein.

Unless otherwise clearly stated herein, all relative directions (e.g., left, right, top, bottom, above, below) mentioned herein in relation to an article are from the perspective of the article itself and, therefore, are consistent across different views.

Whenever a specific value is mentioned herein, such a reference is intended to include that specific value or substantially or approximately that value. In this regard, the foregoing use of the word "substantially" is intended to encompass values that are not substantially different from the stated value, i.e., permitting deviations that would not have substantial impact within the identified context. For example, stating that a continuously variable signal level is set to a particular value should be understood to include values within a range around such specifically stated value that produce substantially the same effect as the specifically stated value. For example, the identification of a single length, width, depth, thickness, etc. should be understood to include values within a range around such specifically stated value that produce substantially the same effect as the specifically stated value. As used herein, except to the extent expressly and specifically stated otherwise, the term "approximately" can mean, e.g.: within ±10% of the stated value or within ±20% of the stated value.

In the event of any conflict or inconsistency between the disclosure explicitly set forth herein or in the accompanying drawings, on the one hand, and any materials incorporated by reference herein (whether explicitly or by operation of any applicable law, regulation or rule), on the other, the present disclosure shall take precedence. In the event of any conflict or inconsistency between the disclosures of any applications or patents incorporated by reference herein, the disclosure most recently added or changed shall take precedence.

Unless clearly indicated to the contrary, words such as "optimal", "optimize", "maximize", "minimize", "best", as well as similar words and other words and suffixes denoting comparison, in the above discussion are not used in their absolute sense. Instead, such terms ordinarily are intended to be understood in light of any other potential constraints, such as user-specified constraints and objectives, as well as cost and processing or manufacturing constraints.

As used herein, the words "include", "includes", "including", and all other forms of the word should not be understood as limiting, but rather any specific items following such words should be understood as being merely exemplary.

Several different embodiments of the present invention are described above and/or in any documents incorporated by reference herein, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the intent and the scope of the invention. Accordingly, the invention is not limited to the precise embodiments shown in the drawings and described above. Rather, it is intended that all such variations not departing from the intent of the invention are to be considered as within the scope thereof, as limited solely by the claims appended hereto.

What is claimed is:

1. A game system, comprising:

a plurality of game pieces, wherein each of the game pieces has a perimeter that includes plural edges, such that each edge of any individual one of the game pieces meshes with each edge of any other individual one of the game pieces, wherein all of the edges, across all of the game pieces, are identical to each other, wherein each of the edges is contoured such that when a first edge of a first piece is meshed with a second edge of a second piece, movement between the first piece and the second piece is limited, but the first piece and the second piece are not interlocked with each other so that they can be simply slid apart from each other, wherein the perimeter around each of the game pieces is based on a same polygon shape, and wherein the game pieces include single-polygon pieces, each in the form of a single one of same polygon shape but with the contoured edges.

2. A game system, comprising:

a plurality of game pieces, wherein each of the game pieces has a perimeter that includes plural edges, such that each edge of any individual one of the game pieces meshes with each edge of any other individual one of the game pieces, wherein all of the edges, across all of the game pieces, are identical to each other, wherein each of the edges is contoured such that when a first edge of a first piece is meshed with a second edge of a second piece, movement between the first piece and the second piece is limited, but the first piece and the second piece are not interlocked with each other so that they can be simply slid apart from each other, and wherein the game pieces include a single-hex piece, and the perimeter of said single-hex piece has exactly six of the edges and is based on a hexagon.

3. The game system according to claim 1, wherein if any one of the edges is divided exactly in half, a resulting right side of the edge is identical to a resulting left side of the edge when rotated 180°.

4. The game system according to claim 1, wherein at each position around the perimeter around each of the game pieces, the contoured edge includes just a single point.

5. The game system according to claim 1, wherein the perimeter around each of the game pieces varies smoothly and continuously across its entire length.

6. The game system according to claim 1, wherein the same polygon shape is a regular polygon.

7. The game system according to claim 1, wherein the game pieces also include multi-polygon pieces, each including a plurality of single-polygon pieces that are permanently attached to each other.

8. The game system according to claim 1, wherein the single-polygon pieces include buildable single-polygon pieces, each having: (a) a bottom portion with a periphery in the same polygon shape with the contoured edges and a bottom surface having an opening, and (b) a top portion having a periphery with a same shape as, but slightly smaller than, the opening, thereby permitting a first one of the buildable single-polygon pieces to be stacked on top of a second one of the buildable single-polygon pieces in a nested manner.

9. The game system according to claim 8, wherein when the first one of the buildable single-polygon pieces is stacked on top of the second one of the buildable single-polygon pieces in said nested manner there exists a clearance fit, which allows for easy, one-handed removal of the first one of the buildable single-polygon pieces, but is not so loose as would permit any significant rotation or translation.

10. The game system according to claim 9, wherein the opening is 0.3-0.5 millimeter (mm) wider than the periphery of the top portion.

11. The game system according to claim 8, wherein the single-polygon pieces also include non-buildable single-polygon pieces, each having the bottom portion, but excluding the top portion, thereby precluding nested stacking on top of said non-buildable single-polygon piece.

12. The game system according to claim 11, each of the non-buildable single-polygon pieces is identical to each of the buildable single-polygon pieces, but with the top portion replaced with an entirely flat top surface.

13. A game system, comprising:

a plurality of game pieces, wherein each of the game pieces has a perimeter that includes plural edges, such that each edge of any individual one of the game pieces meshes with each edge of any other individual one of the game pieces, wherein all of the edges, across all of the game pieces, are identical to each other, wherein each of the edges is contoured such that when a first edge of a first piece is meshed with a second edge of a second piece, movement between the first piece and the second piece is limited, but the first piece and the second piece are not interlocked with each other so that they can be simply slid apart from each other, and wherein the perimeter around each of the game pieces is based on a regular hexagon.

14. A game system, comprising:

a plurality of game pieces, wherein each of the game pieces has a perimeter that includes plural edges, such that each edge of any individual one of the game pieces meshes with each edge of any other individual one of the game pieces; and a plurality of elongated border pieces, each including a first end having a male mating component, a second end having a female mating component, and an inner side having a plurality of the edges such that the inner side meshes with the game pieces, wherein all of the edges, across all of the game pieces, are identical to each other, and wherein each of the edges is contoured such that when a first edge of a first piece is meshed with a second edge of a second piece, movement between the first piece and the second piece is limited, but the first piece and the second piece are not interlocked with each other so that they can be simply slid apart from each other.

15. The game system according to claim 14, wherein the male insertion member mates with the female opening, such that the elongated border pieces can be attached end-to-end so as to form a larger desired structure.

16. The game system according to claim 15, wherein the larger desired structure fully encloses a desired area.

17. The game system according to claim 14, wherein each of the elongated border pieces also has an outer side that includes at least one storage opening.

18. The game system according to claim 14, wherein the male insertion member mates with the female opening as a light press fit.

19. The game system according to claim 14, wherein the perimeter around each of the game pieces is based on a same polygon shape.

20. The game system according to claim 19, wherein the game pieces include single-polygon pieces, each in the form of a single one of same polygon shape but with the contoured edges.

* * * * *